United States Patent [19]

Trishevsky et al.

[11] Patent Number: 4,558,577

[45] Date of Patent: Dec. 17, 1985

[54] ROLL-FORMING MACHINE FOR MAKING ARTICLES HAVING CROSS-SECTIONAL CONFIGURATIONS VARYING LENGTHWISE

[75] Inventors: Igor S. Trishevsky; Ivan E. Patseka; Eduard M. Temnikov; Alexandr G. Borisenko; Mark E. Doktorov, all of Kharkov; Grigory R. Kheifets, Kramatorsk; Vladimir V. Lanko; Sergei V. Miroshnichenko, both of Kharkov, all of U.S.S.R.

[73] Assignee: Ukrainsky Nauchnoissledovatelsky Institut Metallov, Kharkov, U.S.S.R.

[21] Appl. No.: 455,577

[22] Filed: Jan. 4, 1983

[51] Int. Cl.[4] ..... B21D 5/08; B21D 5/14

[52] U.S. Cl. ..... 72/12; 72/16; 72/17; 72/181; 72/182

[58] Field of Search ..... 72/181, 182, 179, 17, 72/10, 31, 240, 366, 12, 16

[56] References Cited

U.S. PATENT DOCUMENTS

| | | | |
|---|---|---|---|
| 2,552,459 | 5/1951 | Rice | 72/17 |
| 2,931,917 | 4/1960 | Beelitz | 72/16 |
| 3,225,577 | 12/1965 | Sloan | 72/17 |
| 3,323,341 | 6/1967 | Chang | 72/176 |
| 3,733,868 | 5/1973 | Welty | 72/181 |
| 3,760,621 | 9/1973 | Fujii et al. | 72/12 |
| 3,785,191 | 1/1974 | Dewey | 72/181 |
| 3,903,723 | 9/1975 | Colbath | 72/181 |
| 3,914,971 | 10/1975 | Colbath | 72/181 |
| 4,006,617 | 2/1977 | Foster | 72/240 |
| 4,248,072 | 2/1981 | Hasegawa et al. | 72/17 |

FOREIGN PATENT DOCUMENTS

| | | | |
|---|---|---|---|
| 76150 | 7/1978 | Japan | 72/17 |

*Primary Examiner*—Daniel C. Crane

*Attorney, Agent, or Firm*—Fleit, Jacobson, Cohn & Price

[57] ABSTRACT

The roll-forming machine includes a series of roll-forming stands for shaping a flat workpiece into a desired configuration, a device for monitoring the positioning of the workpiece at the entry side of the roll-forming machine, and a control unit for sending signals to each roll-forming stand to effect transverse movement of the forming members according to a predetermined roll-forming pattern. The roll-forming stand may have either driven contoured rolls or nondriven forming rollers.

4 Claims, 10 Drawing Figures

ROLL-FORMING MACHINE FOR MAKING ARTICLES HAVING CROSS-SECTIONAL CONFIGURATIONS VARYING LENGTHWISE

BACKGROUND OF THE INVENTION

1. Field of the Invention

The invention relates to the art of metal shaping and more particularly to roll-forming apparatus for manufacturing roll-formed configurations for special applications and may be used for making articles from a workpiece having cross-sectional configurations varying lengthwise thereof.

2. Description of the Prior Art

In modern practice roll-formed sections are made in roll-forming machines from a workpiece having a constant cross-sectional configuration lengthwise thereof and made of unsorted and low-alloyed steels in by-the-piece manufacturing processes as well as by-the-roll and continuous processes. Conventional roll-forming machines do not provide for making special-purpose sections from a workpiece having cross-sectional configurations varying lengthwise thereof. Such sections are useful, for example, in producing support members forming part of automotive frames. The problem involved in roll-forming machines stem from a need to produce roll-formed articles having cross-sectional configurations varying lengthwise thereof from workpieces of various steels and having various thicknesses and at the same time having cross-sectional configurations that vary lengthwise thereof.

Known in the art is a roll-forming machine (U.S. Pat. No. 3,903,723) comprising a series of roll-forming stands including groups of associated forming members mounted on transverse supporting members and transversely movable under the action of a drive relative to the path of movement of a workpiece to be formed, a device for monitoring the positioning of the workpiece with respect to the path of workpiece movement, arranged at the entry side of the roll-forming machine, and a control unit for controlling the positioning of the groups of forming members with respect to the path of workpiece movement.

In the prior art machine the device for monitoring the positioning of the workpiece is not connected to any means that would be giving information to each roll-forming stand in accordance with the forming pattern. This device can be adjusted for only one configuration of the workpiece. In changing over to another configuration of the workpiece the roll-forming machine is readjusted, while the monitoring of the workpiece of a complicated configuration, for example that with transverse dimensions alternately widening and narrowing, is impossible. The control unit for controlling transverse movement of the forming members comprises a common drive shaft to thereby place limitation on the scope of working of the roll-forming machine primarily because all the clutches and the transverse supporting members, in this instance lead screws, in all the forming stands rotate simultaneously in one and the same direction. Therefore it is possible to process only widening or narrowing workpieces. A workpiece of a complicated configuration can not be roll-formed, otherwise it would be necessary that the lead screws in some roll-forming stands rotate in one direction while in some other roll-forming stands they should rotate in the reverse direction. The prior art arrangement cannot be used in the continuous roll-forming process since the workpiece to be formed must be fed into the roll-forming machine to switch on the limit switch with its leading end and thereby actuate the clutches.

Therefore, since the prior art roll-forming machine is composed of the roll-forming stands each having forming members mounted on plates and the plates, in turn, mounted for transverse movement on screws, a plate is likely to be stuck on the screws due to pitch deviations or cross-threading in operation as a result of irregular loading.

The present invention is directed to offset these difficulties.

SUMMARY OF THE INVENTION

An object of the present invention is the provision of a roll-forming machine for making articles having cross-sectional configurations varying lengthwise thereof and with alternately varying width dimensions.

Another object of the invention is the provision of a roll-forming stand for use in a roll-forming machine, wherein it is possible to move the forming members, while in operation, both ways—in the direction of separation and bringing together of the forming members.

In a roll-forming machine according to the invention the device for monitoring the positioning of the workpiece comprises a converter for controlling the transverse movement of the groups of forming members with respect to variations in a transverse dimension of the workpiece, the converter being positioned to be adjacent the edge of the workpiece as it moves into the roll-forming machine and comprising a follower, a roller mounted on the end of the follower for rotation in a substantially vertical plane, an elastic member for urging the follower to the edge of the workpiece, and the control unit is connected to the converter and comprises a programming device for setting the direction of transverse movements of the forming members and the speed of such movements, a signal divider for dividing the signals from the converter, the signal divider being connected to the drive for effecting transverse movements of the forming members of each roll-forming stand.

Such arrangement provides for continuously monitoring variations in transverse dimensions of the workpiece and according to a predetermined roll-forming pattern it can transmit information to driving means in all the roll-forming stands to correspondingly alter the positioning of the forming members by driving them in a transverse direction. Therefore it is possible to roll-form an article of the channel type wherein the web may have predetermined transverse dimensions lengthwise thereof.

Also, such arrangement makes it possible to use roll-forming stands with either driven contoured rolls or nondriven forming rollers.

In the roll-forming machine of the invention there may be used roll-forming stands having the forming members transversely movable on screws similarly to the prior art arrangement, but the forming members are to be mounted directly on the screws apart from the bearings that ensure rotation of the forming members about the screw axis (this is the case for nondriven forming members). In this case it is advisable to operatively connect the forming members making up a group by a transverse member, which prevents sticking on the screws. In another instance the forming members may be mounted on a splined shaft for sliding thereon and the shaft may be connected to any suitable drive. In this another case the drive for effecting transverse movement of the forming members may preferably be made as a rod at one end thereof connected to the transverse member similar to that in the former case, while at the other end, connected to any suitable motor. Such arrangement also prevents sticking on the screws and permits such a roll-forming stand to be utilized in the roll-forming machine of the invention.

For carrying out roll-forming operations on heavy-gage workpieces a roll-forming stand may comprise a frame consisting of two parts, each supporting at least one group of forming members mounted on driven shafts. In this case one or both parts of the frame may be connected to a drive for effecting transverse movement of the forming members while the portion of a part of the frame, that connects the shafts supporting the forming members, serves as the transverse member.

DESCRIPTION OF THE INVENTION

Figure 1:
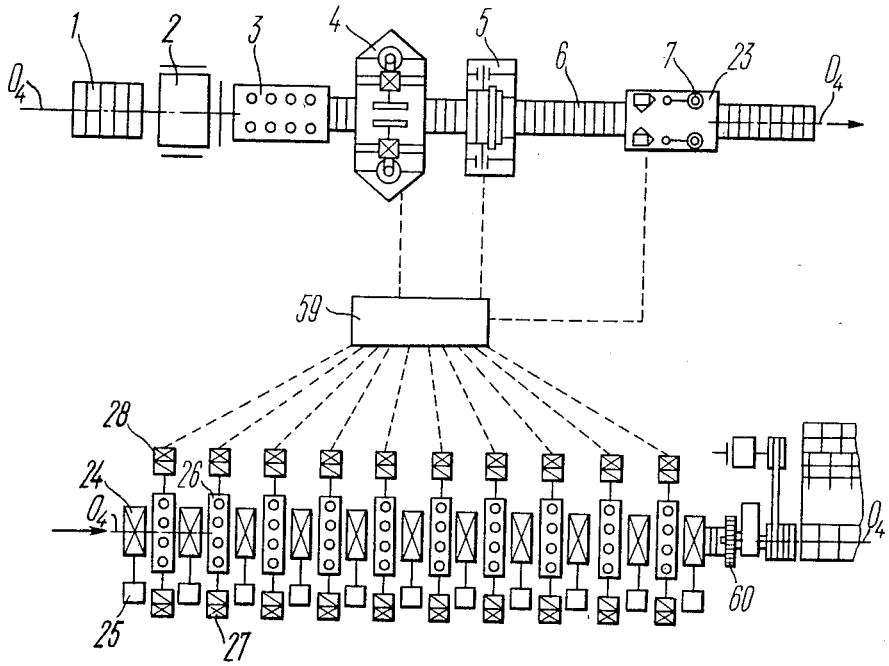
FIG. 1 is a diagrammatical top view of a roll-forming machine of the invention.
Figure 3:
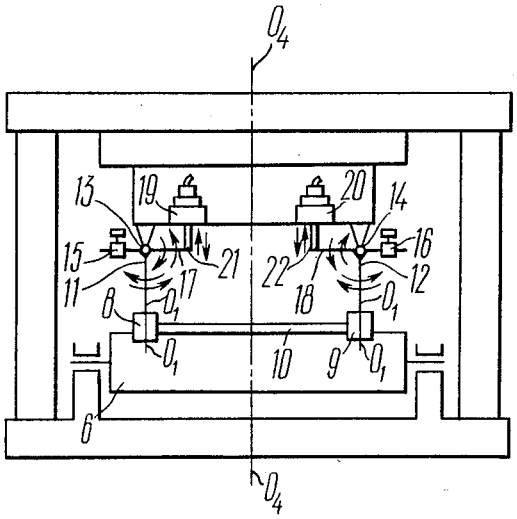
FIG. 3 is a device for monitoring the position of the workpiece to be formed.

A roll-forming machine for making articles having cross-sectional configurations varying lengthwise thereof comprises (FIG. 1) a coil accumulator 1, an uncoiler 2, a straightener 3, a slitter 4, a cutter 5 for cutting a workpiece into lengths (in the case of by-the-piece process), a roller conveyer 6, a device for monitoring the positioning of the workpiece arranged in front of the first roll-forming stand and comprising a converter 7 including (FIG. 3) copying rollers 8 and 9 for maintaining a constant contact with the edges of the workpiece 10 to be formed. The copying rollers are mounted on followers or vertical arms of bell-crank levers 11 and 12 for rotation about the axes $0_1$—$0_1$ and for oscillation about pins 13 and 14 under the action of the workpiece being fed into the roll-forming machine. In order to maintain a constant contact between the copying rollers and the strip-like workpiece there are provided elastic members or weights 15 and 16 secured on the horizontal arms 17 and 18 of the bell-crank levers. To convert the amount of an angular deviation of the copying rollers from an initial position (under the action of a workpiece having a varying width) into an electrical signal there are provided path-control transducers 19 and 20 having contact members 21 and 22. The pins 13 and 14 are mounted on the frame 23.

Figure 4:
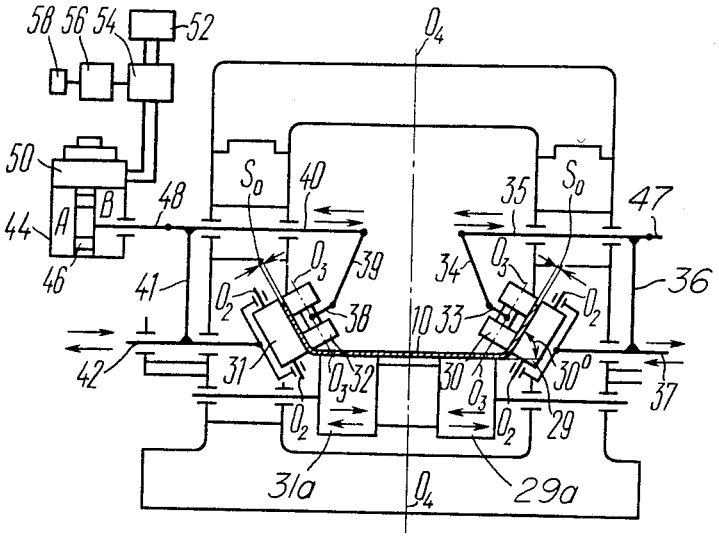
FIG. 4 is an exemplary arrangement of a roll-forming stand at an intermediate forming stage.
Figure 5:
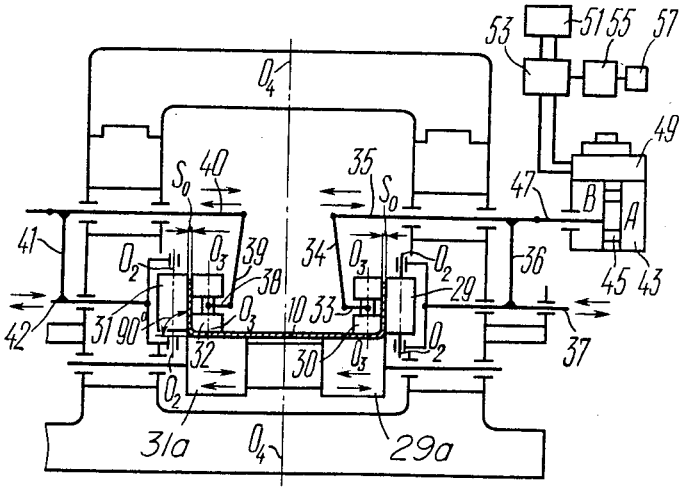
FIG. 5 is a roll-forming stand similar to that of FIG. 4 but at the sizing stage.

In accordance with the course of the roll-forming process the roll-forming machine further comprises (FIG. 1) driving roll stands 24 having drives 25 and roll-forming stands 26 having individual drives 27 and 28 for effecting transverse movement. The driving roll stands comprise cylindrical horizontal rolls having cylinder width that can be varied in the process of roll-forming. The roll-forming stands comprise forming members including pairs of rollers 29, 30 and 31, 32 (FIGS. 4 and 5) which are rotatable about axes $0_2$—$0_2$ and $0_3$—$0_3$ by the action of the workpiece being formed as the bend radii are roll-formed. The pair of the forming rollers 29, 30 is connected with a system of levers 33, 34, 35, 36, and 37 while the pair of the forming rollers 31, 32 is connected with a corresponding system of levers 38, 39, 40, 41, and 42. These lever systems are arranged in guides provided in the frame of the roll-forming stand and ensure coincident and, if desired, independent movement of each pair of the forming rollers in a transverse direction relative to the axis $0_4$—$0_4$ of the roll-forming stand according to the dimensions of a roll-formed article having a predetermined cross-sectional configuration.

The lever systems provide for positioning of each pair of the forming rollers during adjustment for any predetermined angle of bend per pass in accordance with the roll-forming pattern and the workpiece thickness $S_o$.

The drives 27 and 28 for effecting transverse movement may be of a hydraulic type. These comprise (FIGS. 4 and 5) cylinders 43 and 44 wherein pistons 45 and 46 are arranged and connected with piston-rods 47 and 48 which are connected to above mentioned levers 35 and 40 to thereby provide for an independent movement of each pair of the forming rollers with respect to the axis $0_4$—$0_4$ of the roll-forming machine. The barrels of the cylinders also comprise electro-hydraulic distributors 49 and 50. Pressure fluid is delivered from tanks 51 and 52 by pumps 53 and 54 which are actuated by electric motors 55 and 56 having speed governors 57 and 58 arranged on their shafts.

To effect conversion of electrical signals from the device for monitoring the positioning of the workpiece with further transmission of the signals to the drive of a corresponding roll-forming stand there is provided a control unit 59 which is a conventional unit but adapted for attainment of the objects of the invention in the roll-forming machine. The control unit 59 includes primary signal transducers to receive signals from the converter 7, a programming device for setting the direction of transverse movements of the forming members and the speed of such movements, a signal divider connected to corresponding drives for effecting transverse movements of the forming members (the contents of the control unit 59 not disclosed in the drawings and the specification since such arrangements are well known in the art).

Figure 2:
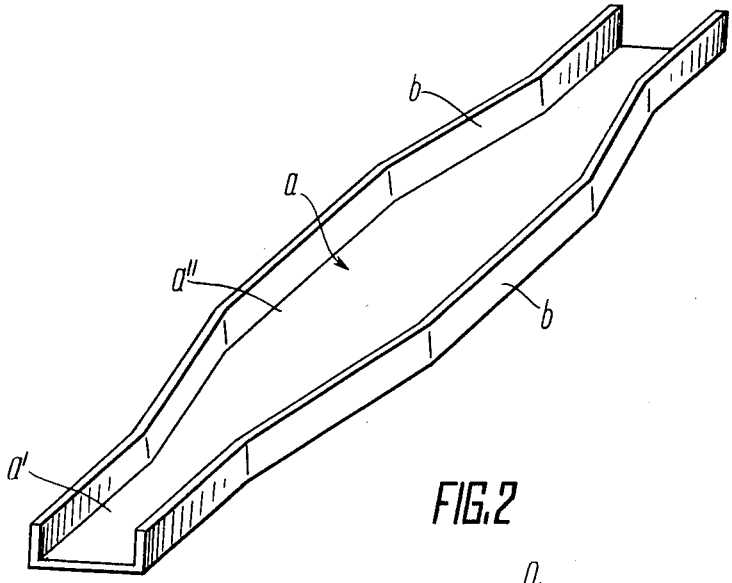
FIG. 2 is an illustrative example of an article that may be made in the roll-forming machine of the invention.

Following the roll-forming stands there is a cutter unit 60 for cutting the roll-formed articles as they pass from the roll-forming machine and further on there is a stacker. FIG. 2 illustrates a typical article that can be made in accordance with the invention. The article includes a web a having alternately varying width, namely narrow portions a′ and wide portions a″. The web a is defined by flanges b which follow the web's configuration.

The roll-forming machine operates as follows. A coiled workpiece is transferred from a storage area by any suitable handling equipment to the coil accumulator 1, which provides for receiving and placing the coil on the uncoiler 2. A bent leading end of the strip is fed to drive rollers of the straightener 3. Following the straightening step the strip is passed to the slitter 4 wherein the strip is lontigudinally cut into a strip workpiece of alternating width lengthwise thereof. Now, if a by-the-piece process is practiced, the step of cutting the workpiece into lengths in the cutter 5 may follow. In the case of the by-the-coil or the continuous processes of roll-forming the strip workpiece having a width that alternatively varies lengthwise thereof, is fed into the roll-forming machine proper on the roller conveyer 6 and by the converter 7. The driving roll stands 24 are equipped with smooth cylinder rolls composed of disk members and having a length not exceeding the width of a corresponding web portion of the article being formed. The roll-forming stands 26 provide bending of a flat workpiece through an angle per pass according to a forming pattern. The size of each pass change as the workpiece is formed in accordance with the width of the workpiece as it enters the roll-forming machine, the width of the flanges as they are bent being maintained unchanged. The pass size is enlarged or reduced by the drives 27 and 28 for effecting transverse movement of the forming members on command from the control unit 59. The signal constituting such a command is received from the converter 7 depending on the width of the workpiece at a particular cross-section.

As the strip workpiece moves its edges contact the copying rollers 8 and 9, which move about the pins 13 and 14. The bell-crank levers 11 and 12 simultaneously swing from their initial position and act on the contact members 21 and 22 of the path-control transducers 19 and 20. The amount of movement of the contact members 21 and 22 corresponds to the angle of deviation of the copying rollers about the pins 13 and 14 and simultaneously to the variation in the workpiece width at a particular cross-section. The amount of movement of the contact members is converted by the path-control transducers 19 and 20 into an electrical signal and is sent to the control unit 59. Having converted the electrical signal the control unit transmits it to the drives 27 and 28 of the roll-forming stands 26. The signal quantity and the time of transmission are interrelated with the speed of the roll-forming process and the distance from a particular cross-section of the workpiece to a corresponding roll-forming stand. Pressure fluid herewith is delivered to one of the head ends A or B of the hydraulic cylinders 43 and 44. When the pressure fluid is delivered, for example into the head end B, the pistons 45 and 46 are displaced toward the head end A. As the pistons move, so do the piston rods 47 and 48 and connected pusher levers 35, 37 and 40, 42 toward the head end A (the pass width increases). Displacement of the pusher levers 35 and 40 necessarily results in displacement of connected levers 33, 34, 36, 37 and 38, 39, 41, 42 of a corresponding pair of the forming rollers 29, 30 and 31, 32 simultaneously to each portion of bending. That is how the pass sizes are enlarged in other roll-forming stands. When the pressure fluid is delivered to the head end A reduction in the pass width is effected and the lever systems together with the forming rollers are displaced in the opposite direction.

Each pair of the forming rollers may be moved simultaneously to enlarge or reduce the pass widths, as well as moving separately. For example, one pair of the forming rollers 29, 30 may be placed at one transverse position relative to the axis $0_4$—$0_4$ and to a corresponding bend angle with the workpiece having a constant dimension at a specified portion lengthwise. In this case the head ends A and B of cylinder 43 are each filled with the pressure fluid to maintain piston 50 stationary and transverse movement of the forming rollers 29, 30 with the system of the levers 33, 34, 35, 36, and 37 with respect to the roll-forming axis $0_4$—$0_4$ is not effected. The pump 53, in this case, delivers the pressure fluid through the electrohydraulic distributor 49 and then to the tank 51.

The roll-formed workpiece is cut by the cutter unit 60 into lengths (with by-the-coil and continuous processes) and following stacking, packing, binding, and weighing is delivered to the stock-yard.

Figure 6:
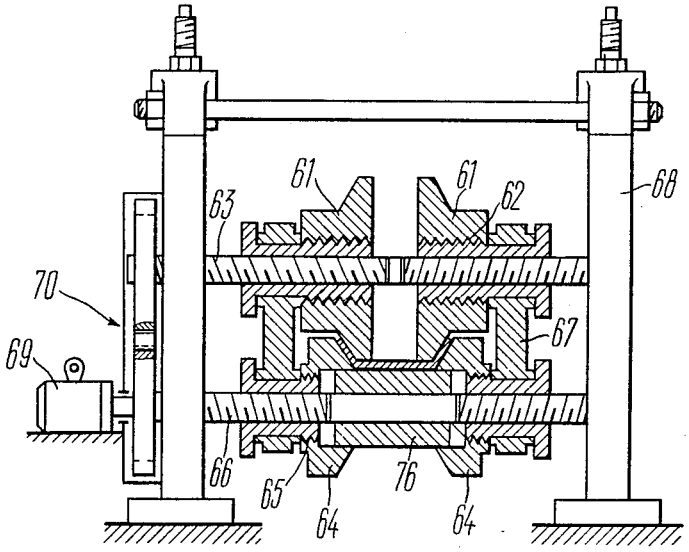
FIG. 6 is an alternative arrangement of a roll-forming stand.

An alternative arrangement of the roll-forming stand is shown in FIG. 6. Upper forming members or rolls 61 are mounted on bearings 62, which threadedly engage lead screws 63. Rolls 64, which are associated with the rolls 61 to make groups, are also mounted on bearings 65, which also threadedly engage lead screws 66. The screws 63 and 66 are correspondingly threaded, for example they have a left-hand thread for the left-hand group of the associated rolls and a right-hand thread for the right-hand group of the associated rolls. The rolls in each group are interconnected by transverse members 67. The lead screws 63 and 66 are mounted on bearings (not shown) in a frame 68 and are rotated under the action of a motor 69 through gearing 70.

Figure 7:
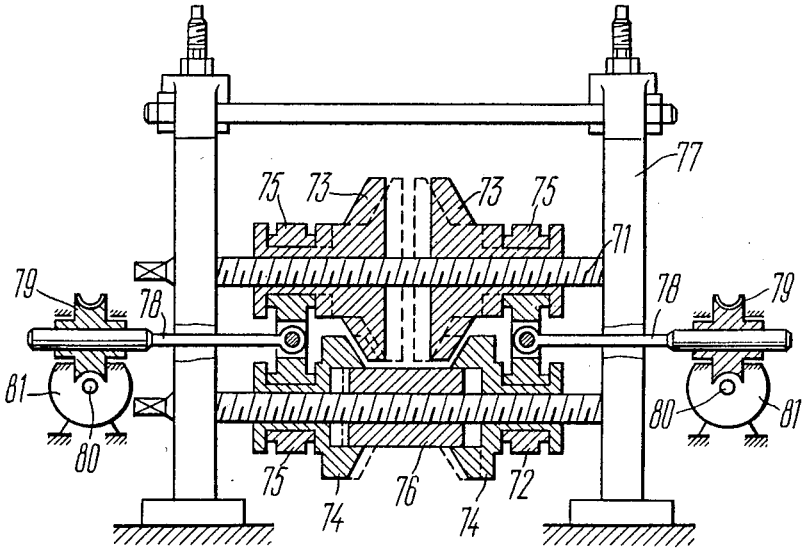
FIG. 7 is a further arrangement of a roll-forming stand.
Figure 8:
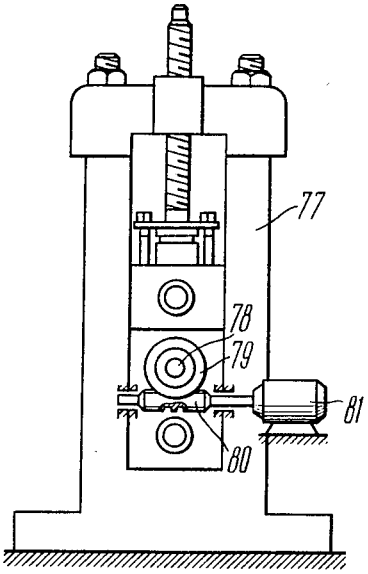
FIG. 8 is a side view of the roll-forming stand of FIG. 7.

Another possible arrangement is now described with reference to FIG. 7. An upper splined shaft 71 and a lower splined shaft 72 provide support for disklike forming members of an upper 73 and a lower 74 rolls. The rolls 73 and 74 are interconnected by a transverse member 75 which is received in corresponding annular grooves in the rolls. To prevent sagging of the web portion of the workpiece there is provided a working member 76 mounted on the lower shaft and at the same time serving as a guide for movable rolls 74. The rolls are mounted in a frame 77 (FIGS. 7 and 8). The rolls 73 and 74, being coupled by the transverse member 75, are connected by a threaded rod 78 with a worm gear 79 which in turn is coupled with a worm shaft 80 and further is connected to an electric motor 81 (FIG. 8). The contour of the rolls 73, 74, and 76 corresponds to a desired configuration of the workpiece at a particular pass. The movable rolls are displaced along the shafts and thereby variations in the pass configuration are effected according to a predetermined forming pattern by an electric motor with allowance for the travel of the workpiece through the roll-forming machine.

A rigid connection of the associated upper rolls 73 and the lower rolls 74 is provided by the transverse members 75 which are slidingly fitted in the annular grooves in the upper rolls and tightly hold the lower rolls in the annular grooves provided therein. Such connection ensures free rotation and coincident displacement of the forming members on the shafts.

For example, roll-forming operations were performed in the roll-forming machine of the invention on a workpiece of alternating width with narrow portions of 258 mm and wide portions of 318 mm to make a channel 5 mm thick with alternating widths of the web that vary from 120 to 180 mm each and constant width flanges equal to 80 mm.

To make an article the workpiece is passed through rolls engaging the workpiece to form different bends according to both shape and dimensions due to transverse movement of the rolls 73 and 74 on the shaft.

Since the associated rolls move transversely in synchronism they are equally spaced apart one from the other throughout the roll-forming process. If the article is to be made with a constant cross-sectional configuration, the electric motor 81 is switched off and the forming rolls are immobilized on their respective shafts to provide an invariable shape and dimensions of the roll pass.

Utilization of such an arrangement of the roll-forming stand makes it possible to produce shapes with either constant or alternating cross-sectional configuration along the length thereof and simultaneously providing well defined bends.

Figure 10:
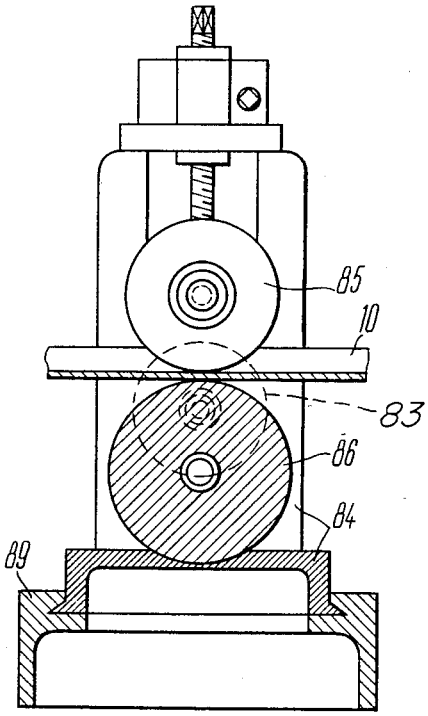
FIG. 10 is a sectional view taken along the line X—X in FIG. 9.
Figure 9:
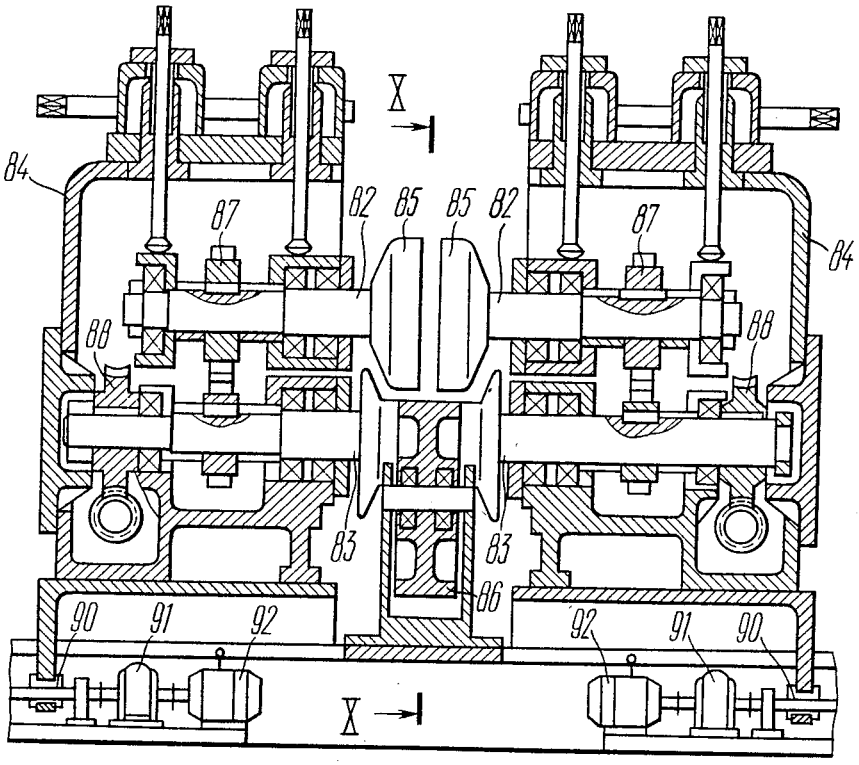
FIG. 9 is yet another arrangement of a roll-forming stand.

Yet another alternative arrangement of the roll-forming stand is shown in FIGS. 9 and 10. An upper cantilever driven shaft 82 and a similar lower shaft 83, both arranged in frames 84 (FIGS. 9 and 10) movable in a transverse direction, provide support for disklike forming members of rolls 85 which together with a support roller 86 define a pass. The configuration of the disklike members of the rolls 85 corresponds to a predetermined shape at a particular pass. The shafts mounted in each of the two frame parts are connected through a gear train 87 with an individual drive, such as an electric motor coupled to a worm gear drive 88. Each of the frames 84 is mounted on a base plate 89 (FIG. 10) for transverse movement with respect to the axis of roll-forming along the guides (not shown) in the base plate. With this end in view the frame is connected through a screw pair 90 and a reduction gear 91 to an electric motor 92.

To make an article with a cross-sectional configuration alternately varying lengthwise thereof the frame parts 84 (FIG. 9) are moved in a transverse direction according to a predetermined forming pattern with due regard to the movement of the workpiece through the roll-forming machine. The pass configuration is varied in time due to movements of the rolls 85. The support roller 86 mounted on the base plate 89 is all the times in contact with the driven rolls 85 and together with the rolls provides a groove variable in time according to a predetermined forming pattern. The frame parts are moved in the base plate 89 by the screw pair 90 driven from the electric motor 92 through the reduction gear 91.

With the frame parts 84 held immovable the shape produced in the roll-forming machine will be constant, if one of the frame parts is moved, the pair of the rolls 85 held in the part will be displaced to vary the width of the shape produced due to the displacement of one of the bends; displacement of both the frame parts will vary the width of the shape by the displacement of both the bends.

This arrangement is useful for making shapes of either constant or alternating cross-sectional configuration along the length thereof and simultaneously providing well defined bends.

What is claimed is:

1. A roll-forming machine for making articles having cross-sectional configurations varying lengthwise thereof, comprising:

a plurality of roll-forming stands positioned in a series defining a path of movement of an elongated workpiece to be formed;

means for moving the workpiece to be formed longitudinally along said path;

a plurality of groups of associated forming members of which at least two groups are mounted on each of said plurality of roll-forming stands for progressively transforming the workpiece from an initial configuration as the workpiece moves along said path by progressively deflecting at least portions of the workpiece away from said path;

means for effecting transverse movement of said plurality of groups of associated forming members relative to the path of movement of the workpiece;

means for monitoring the width of the workpiece to be formed relative to the path of workpiece movement as the workpiece moves through said groups of associated forming members, which monitoring means is arranged at the entry side of the roll-forming machine and comprises:

a converter for controlling the transverse movement of said plurality of groups of associated forming members in accordance with a varying transverse dimension of the workpiece, said converter being positioned to be adjacent the edge of the workpiece as it moves into the roll-forming machine and comprising:

follower means pivotable in a substantially vertical plane, a roller mounted on the end of said follower means for rotation in a substantially horizontal plane, and means for urging said roller into continuous contact with the edge of the workpiece, and path control transducer means operatively connected with said follower means to provide a width signal, whereby variations in a transverse dimension of the workpiece produce movement of said follower and are converted by said transducer means into an output electrical signal for controlling the transverse movements of said plurality of groups of associated forming members;

means for varying the positioning of said plurality of groups of associated forming members transversely with respect to said path of workpiece movement as the workpiece is being formed, said means being connected to said converter and including programming means responsive to said width signal for setting the direction of transverse movements of the forming members and the speed of such movements, a signal divider for dividing the position signals from said transducer means, said signal divider being connected to said means for effecting transverse movements of the forming members for selectively sending thereto signals indicative of the speed of workpiece movement along said path and of the position of said follower means to define a forming pattern, thereby forming the workpiece into a desired configuration characterized by transverse dimensions which vary lengthwise of the workpiece.

2. The roll-forming machine according to claim 1 wherein the means for effecting transverse movement of the plurality of groups of associated forming members comprises a plurality of driving means, one per group, each driving means being connected to the signal divider for being selectively actuated.

3. The roll-forming machine according to claim 2 wherein the forming members in each of the plurality of groups of associated forming members are driven forming rolls.

4. The roll-forming machine according to claim 2 wherein the forming members in each of the plurality of groups of associated forming members are nondriven forming rollers.

* * * * *